US010977997B2

(12) United States Patent
Kim et al.

(10) Patent No.: US 10,977,997 B2
(45) Date of Patent: Apr. 13, 2021

(54) PIXEL AND ORGANIC LIGHT EMITTING DISPLAY DEVICE INCLUDING PIXEL

(71) Applicant: Samsung Display Co., Ltd., Yongin-Si (KR)

(72) Inventors: Ji Tae Kim, Yongin-si (KR); Kyoung Ju Shin, Yongin-si (KR)

(73) Assignee: Samsung Display Co., Ltd.

( * ) Notice: Subject to any disclaimer, the term of this patent is extended or adjusted under 35 U.S.C. 154(b) by 210 days.

(21) Appl. No.: 16/155,854

(22) Filed: Oct. 9, 2018

(65) Prior Publication Data

US 2019/0237018 A1 Aug. 1, 2019

(30) Foreign Application Priority Data

Jan. 30, 2018 (KR) ..... 10-2018-0011549

(51) Int. Cl.
*G09G 3/3241* (2016.01)
*G09G 3/3266* (2016.01)
*G09G 3/3275* (2016.01)

(52) U.S. Cl.
CPC ..... *G09G 3/3241* (2013.01); *G09G 3/3266* (2013.01); *G09G 3/3275* (2013.01); *G09G 2300/0809* (2013.01); *G09G 2310/08* (2013.01); *G09G 2320/062* (2013.01); *G09G 2320/064* (2013.01)

(58) Field of Classification Search
CPC ..... G09G 3/3241
See application file for complete search history.

(56) References Cited

U.S. PATENT DOCUMENTS

| | | | | |
|---|---|---|---|---|
| 8,125,422 | B2 | 2/2012 | Choi | |
| 8,497,885 | B2 | 7/2013 | Ikeda et al. | |
| 8,692,821 | B2 | 4/2014 | Park | |
| 9,165,506 | B2 | 10/2015 | Gu et al. | |
| 9,842,537 | B2 | 12/2017 | Lim et al. | |
| 2012/0062536 | A1* | 3/2012 | Park | G09G 3/3233 345/211 |

FOREIGN PATENT DOCUMENTS

| | | | |
|---|---|---|---|
| KR | 10-0645700 | B1 | 11/2006 |
| KR | 10-2014-0083399 | A | 7/2014 |
| KR | 10-2014-0117121 | A | 10/2014 |
| KR | 10-2016-0087462 | A | 7/2016 |
| KR | 10-1779076 | B1 | 9/2017 |

* cited by examiner

*Primary Examiner* — Gustavo Polo
(74) *Attorney, Agent, or Firm* — Innovation Counsel LLP

(57) ABSTRACT

A pixel includes an organic light emitting diode, a first transistor, a second transistor, and a third transistor. The first transistor includes a first electrode, a second electrode, and a gate electrode and may control a current applied to the organic light emitting diode from a first power source, wherein the gate electrode is electrically connected to a first node. The second transistor is electrically connected between the organic light emitting diode and the second electrode of the first transistor and may turn on in response to a first emission control signal. The third transistor is electrically connected between the first power source and the first electrode of the first transistor and may turn on in response to a second emission control signal. The second transistor may turn on two or more times during one frame. The third transistor may turn on exactly once in the one frame.

14 Claims, 5 Drawing Sheets

PIXEL AND ORGANIC LIGHT EMITTING DISPLAY DEVICE INCLUDING PIXEL

CROSS REFERENCE TO RELATED APPLICATION

This application claims priority to and the benefit of Korean Patent Application No. 10-2018-0011549, filed on Jan. 30, 2018 in the Korean Intellectual Property Office (KIPO); the disclosure of the Korean Patent Application is incorporated by reference herein in its entirety.

BACKGROUND

1. Field

The technical field relates to a pixel and an organic light emitting display device having the pixel.

2. Discussion of Related Art

An organic light emitting display device displays an image using an organic light emitting diode that generates light by recombination of electrons and holes. The organic light emitting display device has the advantage of displaying a clear image at a high response speed.

The organic light emitting display device typically includes a plurality of pixels, a data driver for supplying data signals to the pixels, a scan driver for supplying scan signals to the pixels, and an emission driver for supplying an emission control signal to the pixels.

SUMMARY

Example embodiments may be related to pixels having satisfactory display quality. Example embodiments may be related to organic light emitting display devices having the pixels.

According to example embodiments, a pixel may comprise an organic light emitting diode; a first transistor controlling an amount of a current applied to the organic light emitting diode connected to a second electrode thereof from a first power source connected to a first electrode thereof in response to a voltage of a first node; a second transistor connected between the organic light emitting diode and the second electrode of the first transistor, and turned on in response to a first emission control signal; and a third transistor connected between the first power source and the first electrode of the first transistor, and turned on in response to a second emission control signal. The second transistor may be turned on twice or more during a second period of one frame and the third transistor may be turned on once in the second period.

In example embodiments, periods in which the second transistor may be turned off may overlap a period in which the third transistor is turned on, during the second period.

In example embodiments, the second transistor and the third transistor may be turned off during a first period in the one frame.

In example embodiments, the pixel may further comprise a fourth transistor connected between a data line and the first electrode of the first transistor and including a gate electrode connected to an i-th scan line, where i is a positive integer; a fifth transistor connected between the first node and the second electrode of the first transistor and including a gate electrode connected to the i-th scan line; a sixth transistor connected between the first node and an initialization power source and including a gate electrode connected to an (i−1)-th scan line; a seventh transistor connected between the initialization power source and the organic light emitting diode and including a gate electrode connected to an (i+1)-th scan line; and a storage capacitor connected between the first power source and the first node.

In example embodiments, a voltage of the initialization power source may be set so that the organic light emitting diode does not emit light.

According to example embodiments, an organic light emitting display device may comprise a plurality of pixels connected to scan lines, data lines, first emission control lines, and second emission control lines, respectively; a scan driver applying a scan signal to the scan lines; a data driver applying a data signal to the data lines; a first emission driver applying a first emission control signal to the first emission control lines; and a second emission driver applying a second emission control signal to the second emission control lines. The first and second emission control signals may include a turn-on period for respectively turning on different transistors in each of the pixels and a turn-off period for respectively turning off the different transistors in each of the pixels. The first emission control signal may have a plurality of turn-on periods during a second period of one frame. The second emission control signal may have one turn-on period during the second period.

In example embodiments, turn-off periods of the first emission control signal may overlap the turn-on period of the second emission control signal during the second period.

In example embodiments, the first emission control signal and the second emission control signal may have the turn-off period during a first period of the one frame.

In example embodiments, a ratio of the turn-on period to the turn-off period of the first emission control signal applied during the second period may be adjusted in response to the data signal.

In example embodiments, the turn-on period of the second emission control signal may be substantially constant every frame.

In example embodiments, each of the pixels may include an organic light emitting diode; a first transistor controlling a current applied to the organic light emitting diode connected to a second electrode thereof from a first power source connected to a first electrode thereof in response to a voltage of a first node; a second transistor connected between the organic light emitting diode and the second electrode of the first transistor and including a gate electrode connected to a corresponding first emission control line; and a third transistor connected between the first power source and the first electrode of the first transistor and including a gate electrode connected to a corresponding second emission control line.

In example embodiments, each of the pixels may further include a fourth transistor connected between a corresponding data line and the first electrode of the first transistor and including a gate electrode connected to an i-th scan line, where i is a positive integer; a fifth transistor connected between the first node and the second electrode of the first transistor and including a gate electrode connected to the i-th scan line; a sixth transistor connected between the first node and an initialization power source and including a gate electrode connected to an (i−1)-th scan line; a seventh transistor connected between the initialization power source and the organic light emitting diode and including a gate electrode connected to an (i+1)-th scan line; and a storage capacitor connected between the first power source and the first node.

In example embodiments, a voltage of the initialization power source may be set so that the organic light emitting diode does not emit light.

An embodiment may be related to a pixel. The pixel may include an organic light emitting diode, a first transistor, a second transistor, and a third transistor. The first transistor includes a first electrode, a second electrode, and a gate electrode and may control a current applied to the organic light emitting diode from a first power source, wherein the gate electrode is electrically connected to a first node. The second transistor is electrically connected between the organic light emitting diode and the second electrode of the first transistor and may turn on in response to a first emission control signal. The third transistor is electrically connected between the first power source and the first electrode of the first transistor and may turn on in response to a second emission control signal. The second transistor may turn on two or more times during one frame. The third transistor may turn on exactly once in the one frame.

During the one frame, periods in which the second transistor is off may overlap a period in which the third transistor is on.

The second transistor and the third transistor may be off during a first period in the one frame.

The pixel may further include the following elements: a fourth transistor electrically connected between a data line and the first electrode of the first transistor and including a gate electrode electrically connected to an i-th scan line, where i is a positive integer; a fifth transistor electrically connected between the first node and the second electrode of the first transistor and including a gate electrode electrically connected to the i-th scan line; a sixth transistor electrically connected between the first node and an initialization power source and including a gate electrode electrically connected to an (i−1)-th scan line; a seventh transistor electrically connected between the initialization power source and the organic light emitting diode and including a gate electrode electrically connected to an (i+1)-th scan line; and a storage capacitor electrically connected between the first power source and the first node.

A voltage of the initialization power source may be set so that the organic light emitting diode does not emit light.

An embodiment may be related to an organic light emitting display device. The organic light emitting display device may include the following elements: a pixel; a scan line, a data line, a first emission control line, and a second emission control lines electrically insulated from one another and each electrically connected to the pixel; a scan driver applying a scan signal to the pixel through the scan line; a data driver applying a data signal to the pixel through the data line; a first emission driver applying a first emission control signal to the pixel through the first emission control line; and a second emission driver applying a second emission control signal to the pixel through the second emission control line The first emission control signal line and the second emission control signal line may be respectively electrically connected to two gate electrodes of two different transistors in the pixel. The first emission control signal may have a plurality of on periods during one frame. The second emission control signal may have exactly one on period during the one frame.

Off periods of the first emission control signal may overlap the on period of the second emission control signal during the one frame.

The first emission control signal and the second emission control signal may be off signals during a first period of the one frame.

The device may further include a timing controller electrically connected to the first emission driver. At least one of the timing controller and the first emission driver may adjust a ratio of an on period to an off period of the first emission control signal applied during the one frame in response to the data signal.

An on period of the second emission control signal may be substantially constant for every frame of a plurality of frames.

The pixel may include the following elements: an organic light emitting diode; a first transistor comprising a first electrode, a second electrode, and a gate electrode and configured for controlling a current applied to the organic light emitting diode from a first power source, wherein the gate electrode of the first transistor is electrically connected to a first node; a second transistor electrically connected between the organic light emitting diode and the second electrode of the first transistor and including a gate electrode connected to the first emission control line; and a third transistor electrically connected between the first power source and the first electrode of the first transistor and including a gate electrode connected to the second emission control line.

The pixel may further include the following elements: a fourth transistor electrically connected between the data line and the first electrode of the first transistor and including a gate electrode electrically connected to the scan line; a fifth transistor electrically connected between the first node and the second electrode of the first transistor and including a gate electrode electrically connected to the scan line; a first control line configured to transmit a first control signal; a sixth transistor electrically connected between the first node and an initialization power source and including a gate electrode electrically connected to the first control line; a second control line configured to transmit a second control signal; a seventh transistor electrically connected between the initialization power source and the organic light emitting diode and including a gate electrode electrically connected to the second control line; and a storage capacitor electrically connected between the first power source and the first node.

A voltage of the initialization power source may be set so that the organic light emitting diode does not emit light.

DETAILED DESCRIPTION OF EMBODIMENTS

Figure 1:
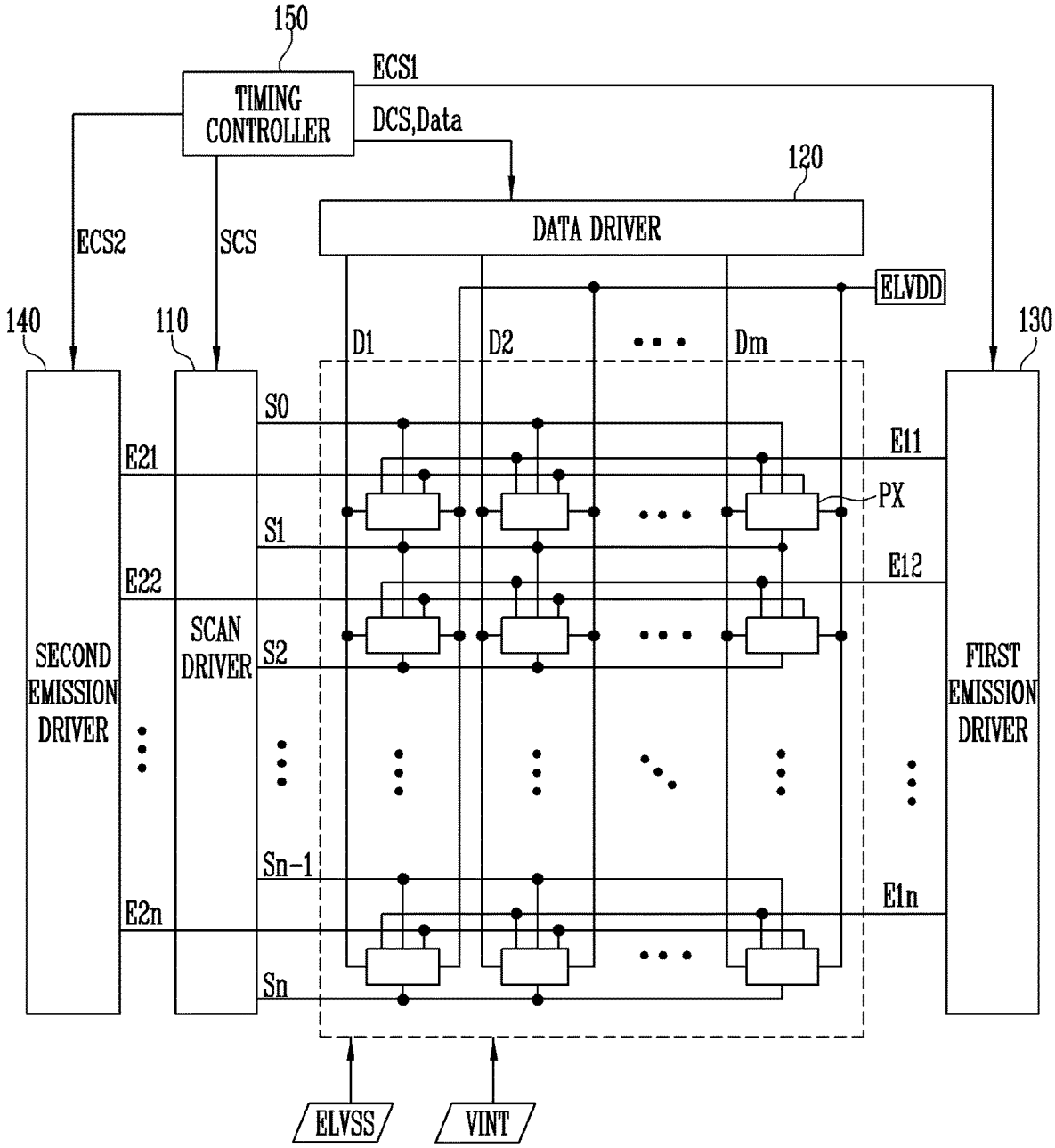
FIG. 1 is a block diagram of an organic light emitting display device according to example embodiments.

Example embodiments are described with reference to the accompanying drawings. Practical embodiments may be embodied in many different forms and should not be construed as limited to the example embodiments. Embodiments are intended to cover all modifications, equivalents, and alternatives.

Like reference numerals may be used for indicating similar elements. In the drawings, sizes and relative sizes of layers and regions may be exaggerated for clarity.

Although the terms "first," "second," "third," etc. may be used herein to describe various elements, these elements should not be limited by these terms. These terms are used to distinguish one element from another element. Thus, a first element may be termed a second element without departing from the teachings of example embodiments. The description of an element as a "first" element may not require or imply the presence of a second element or other elements. The terms "first," "second," etc. may also be used herein to differentiate different categories or sets of elements. For conciseness, the terms "first," "second," etc. may represent "first-type (or first-set)," "second-type (or second-set)," etc., respectively.

As used herein, the singular forms "a," "an," and "the" may include the plural forms as well, unless the context clearly indicates otherwise.

The terms "comprises" and/or "comprising," when used in this specification, may specify the presence of stated features, integers, steps, operations, elements, and/or components, but do not preclude the presence or addition of one or more other features, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. The spatially relative terms may encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below.

The term "connect" may mean "electrically connect"; the term "insulate" may mean "electrically insulate" or electrically isolate"; the term "turn-on," "turn on," or "turned on" may mean "or" or "electrically connecting"; the term "turn-off," "turn off" or "turned off" may mean "off" or "electrically disconnecting."

FIG. 1 is a block diagram of an organic light emitting display device according to example embodiments.

Referring to FIG. 1, the organic light emitting display device may include pixels PX, a scan driver 110, a data driver 120, a first emission driver 130, a second emission driver 140, and a timing controller 150.

The pixels PX may be connected to scan lines (S0, S1, S2, . . . Sn−1, Sn), first emission control lines (E11, E12, . . . E1*n*), second emission control lines (E21, E22, . . . E2*n*, and data lines (D1, D2, . . . Dm). The pixels PX may be arranged in a matrix form.

Pixels PX may be connected to a previous scan line and a next scan line. For example, the pixels PX in an i-th horizontal line (pixel line/row) may be connected to an (i−1)-th scan line Si−1, an i-th scan line Si, and an (i+1)-th scan line Si+1, where i is a positive integer.

The pixels PX may be connected to a first power source ELVDD, a second power source ELVSS, and an initialization power source VINT.

The pixels PX may be selected by units of horizontal lines corresponding to scan signals applied from the scan lines S0 to Sn. The pixels PX selected by the scan signals may emit light with luminance levels corresponding to data signals applied from the data lines D1 to Dm.

Emission times (and durations) of the pixels PX may be controlled by first emission control signals applied from the first emission control lines E11 to E1*n*.

An organic light emitting diode included in each of the pixels PX may be initialized to a voltage of the initialization power source VINT when a scan signal is supplied to the next scan line. For example, the pixels PX located on the i-th horizontal line may be initialized when the scan signal is supplied to the (i+1)-th scan line Si+1.

The scan driver 110 may be connected to the scan lines S0 to Sn and may supply scan signals to the scan lines S0 to Sn in response to a scan driving control signal SCS of the timing controller 150.

In some embodiments, the scan driver 110 may include a plurality of stage circuits, and may sequentially supply scan signals to the scan lines S0 to Sn. When scan signals are sequentially supplied to the scan lines S0 to Sn, the pixels PX may be selected in units of horizontal lines. The scan signals may be set to a gate-on voltage at which the transistors included in the pixels PX are turned on.

The data driver 120 may be connected to the data lines D1 to Dm and may supply data signals to the data lines D1 to Dm in response to a data driving control signal DCS of the timing controller 150.

In some embodiments, the data driver 120 may convert digital image data Data provided from the timing controller 150 into analog data signals and may output the data signals to the data lines D1 to Dm. The data signals output to the data lines D1 to Dm may be provided to the pixels PX of the horizontal line selected by the scan signal.

The first emission driver 130 may be connected to the first emission control lines E11 to E1*n*. The first emission driver 130 may supply first emission control signals (i.e., first-type emission control signals) to the first emission control lines E11 to E1*n* in response to a first emission driving control signal ECS1 from the timing controller 150.

The first emission control signals are used to control the emission times of the pixels PX. A first emission control signal may include a turn-on period for turning (and maintaining) on an emission control transistor included in a pixel PX and may include a turn-off period for turning (and maintaining) off the emission control transistor. A first emission control signal may be set to the gate-on voltage during the turn-on period and set to the gate-off voltage during the turn-off period.

The organic light emitting display device may perform impulse driving in which turn-on and turn-off of the emission control transistor are repeated within one frame (i.e., one image frame period) for each of the pixels PX. Accordingly, the first emission driver 130 may supply first emission control signals each having a plurality of turn-on periods and turn-off periods to the pixels PX located on one horizontal line for one frame.

The second emission driver 140 may be connected to the second emission control lines E21 to E2*n*. The second emission driver 140 may supply second emission control signals (i.e., second-type emission control signals) to the second emission control lines E21 to E2*n* in response to a second emission driving control signal ECS2 from the timing controller 150.

The second emission control signals are used for connection of the pixels PX and the first power source ELVDD. A second emission control signal may include a turn-on period for turning (and maintaining) on a transistor included in a pixel PX and may include a turn-off period for turning (maintaining) off the transistor included in the pixel PX. The second emission control signal may be set to the gate-on voltage during the turn-on period, and may be set to the gate-off voltage during the turn-off period.

The organic light emitting display device may supply second emission control signals having the turn-on period during the emission period of the pixels PX.

The timing controller 150 may convert image data input from an external device into image data Data suitable for image display and may supply the image data Data to the data driver 120.

The timing controller 150 may generate the data driving control signal DCS, the scan driving control signal SCS, and the first and second emission driving control signals ECS1 and ESC2 in response to externally supplied control signals.

The scan driving control signal SCS may be supplied to the scan driver 110, the data driving control signal DCS may be supplied to the data driver 120, the first emission driving control signal ECS1 may be supplied to the first emission driver 130, and the second emission driving control signal ECS2 may be supplied to the second emission driver 140.

The scan driving control signal SCS may include a scan start signal and clock signals. The scan start signal may control a supply timing of the scan signal, and the clock signals may be used to shift the scan start signal.

The data driving control signal DCS may include a source start signal, a source output enable signal, a source sampling clock, and the like. The source start signal may control a data sampling start timing of the data driver 120. The source sampling clock may control a sampling operation of the data driver 120 based on a rising or falling edge. The source output enable signal may control an output timing of the data driver 120.

The first emission driving control signal ECS1 and the second emission driving control signal ECS2 may include an emission start signal and clock signals. The emission start signal may control a supply timing of the emission control signal, and the clock signals may be used to shift the emission start signal.

Signal lines including n+1 scan lines S0 to Sn, n first emission control lines E11 to E1*n*, and n second emission control lines E21 to E2*n* are illustrated in FIG. 1. In embodiments, dummy scan lines and/or dummy emission control lines may be additionally formed for driving stability.

Although the scan driver 110, the data driver 120, the first emission driver 130, the second emission driver 140, and the timing controller 150 are separately shown in FIG. 1, at least some of the components may be integrated.

The scan driver 110, the data driver 120, the first emission driver 130, the second emission driver 140, and the timing controller 150 may be provided using various methods including a chip on glass, a chip on plastic, a tape carrier package, a chip on film, or the like.

Figure 2A:
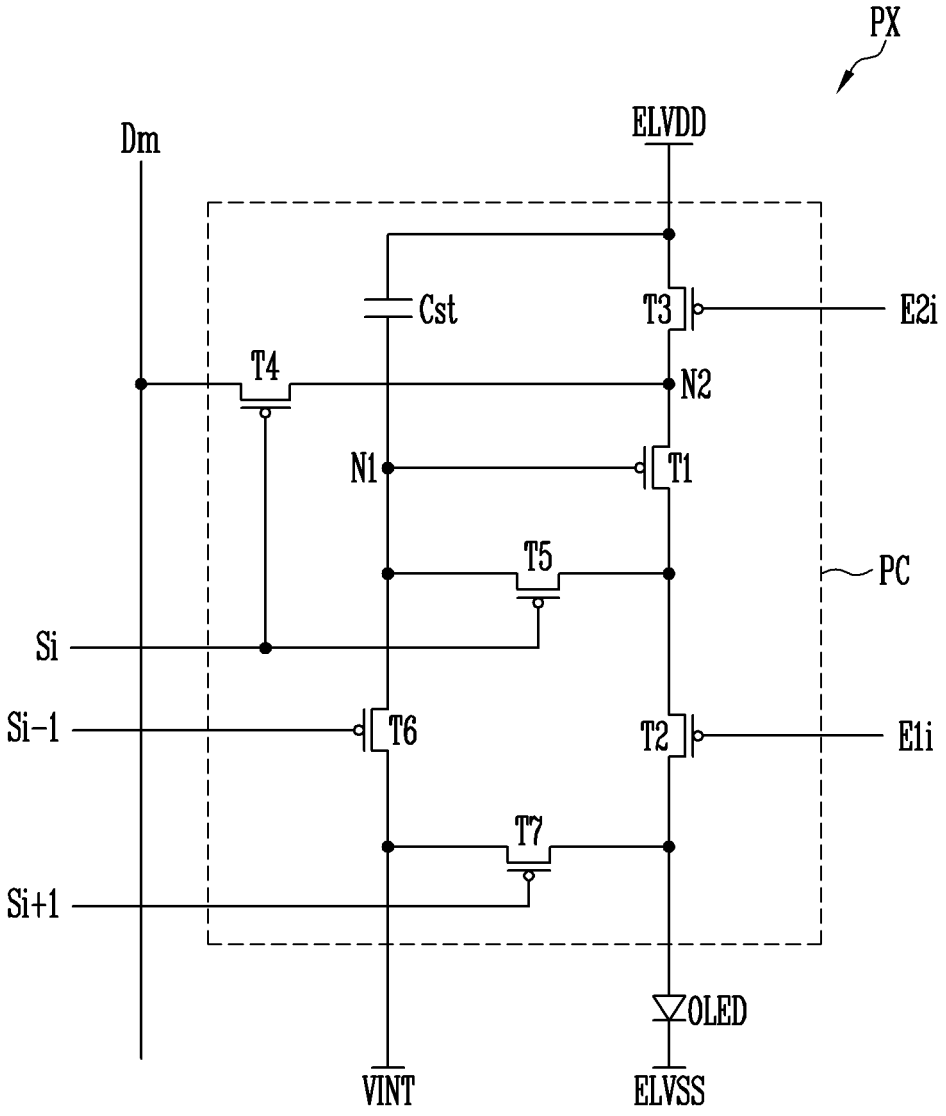
FIG. 2A is a circuit diagram of a pixel according to example embodiments.
Figure 2B:
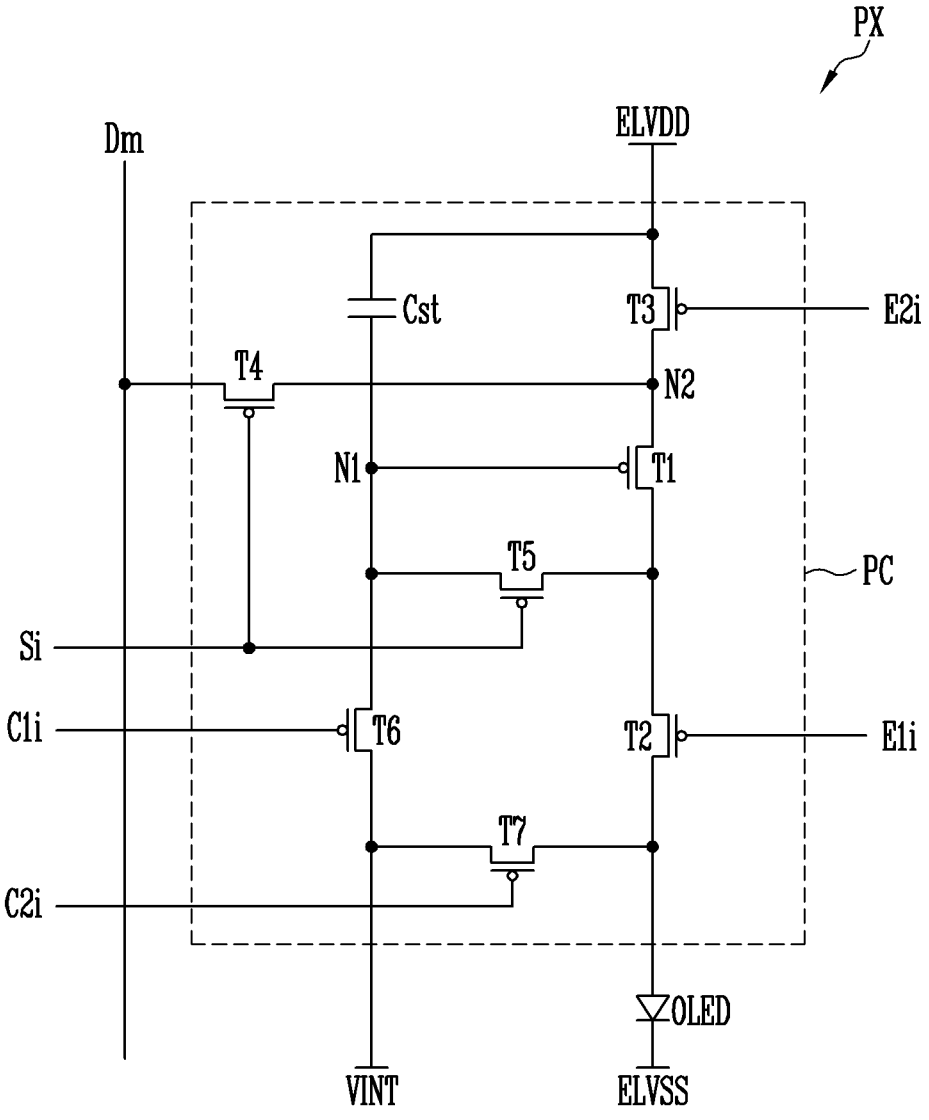
FIG. 2B is a circuit diagram of a pixel according to example embodiments.

FIG. 2A is a circuit diagram of the pixel PX according to example embodiments. FIG. 2B is a circuit diagram of the pixel PX according to example embodiments.

In FIG. 2A, one pixel PX connected to the i-th scan line Si and an m-th data line Dm is illustrated for convenience of explanation, where m is a positive integer.

Referring to FIG. 2A, the pixel PX may include a pixel circuit PC and an organic light emitting diode OLED.

An anode electrode of the organic light emitting diode OLED may be connected to the pixel circuit PC and a cathode electrode of the organic light emitting diode OLED may be connected to the second power source ELVSS.

The organic light emitting diode OLED may generate light of a predetermined luminance corresponding to a driving current supplied from the pixel circuit PC.

The first power source ELVDD may be set to a voltage higher than the second power ELVSS so that a current may flow through the organic light emitting diode OLED.

The pixel circuit PC may control the amount of current flowing from the first power source ELVDD to the second power source ELVSS through the organic light emitting diode OLED in response to the data signal. The pixel circuit PC may include a first transistor T1, a second transistor T2, a third transistor T3, a fourth transistor T4, a fifth transistor T5, a sixth transistor T6, a seventh transistor T7, and a storage capacitor Cst.

The first transistor T1 (e.g., driving transistor) may control the amount of the current supplied from the first power source ELVDD to the organic light emitting diode OLED in response to a voltage of the first node N1. A first electrode of the first transistor T1 may be connected to a second node N2 (source node), and a second electrode of the first transistor T1 may be connected to a first electrode of the second transistor T2. A gate electrode of the first transistor T1 may be connected to the first node N1.

The first transistor T1 may control the amount of the driving current flowing from the first power source ELVDD to the second power source ELVSS via the organic light emitting diode OLED in response to the data signal supplied to the m-th data line Dm.

The second transistor T2 (e.g., emission control transistor) may be connected between the second electrode of the first transistor T1 and the anode electrode of the organic light emitting diode OLED. A gate electrode of the second transistor T2 may be connected to an i-th first emission control line E1*i*.

In some embodiments, the first emission control signal may include a turn-on period and a turn-off period. The first emission control signal may be set to a gate-on voltage during the turn-on period, and may be set to a gate-off voltage during the turn-off period. Therefore, the second transistor T2 may be turned on during the turn-on period of the first emission control signal supplied to the i-th first emission control line E1*i*, and may be turned off during the turn-off period of the first emission control signal.

The third transistor T3 may be connected between the first power source ELVDD and the second node N2. In other words, the third transistor T3 may be connected between the first power source ELVDD and the first electrode of the first transistor T1. A gate electrode of the third transistor T3 may be connected to an i-th second emission control line E2*i*.

In some embodiments, the second emission control signal may include a turn-on period and a turn-off period. The second emission control signal may be set to a gate-on voltage during a turn-on period, and may be set to a gate turn-off voltage during a turn-off period. Therefore, the third transistor T3 may be turned on during the turn-on period of the second emission control signal supplied to the i-th second emission control line E2*i*, and may be turned off during the turn-off period of the second emission control signal.

The fourth transistor T4 may be connected between the m-th data line Dm and the second node N2. In other words, the fourth transistor T4 may be connected between the first electrode of the first transistor T1 and the m-th data line Dm.

A gate electrode of the fourth transistor T4 may be connected to the i-th scan line Si. The fourth transistor T4 may be turned on to electrically connect the m-th data line Dm and the second node N2 when a scan signal is supplied to the i-th scan line Si.

The fifth transistor T5 may be connected between the second electrode of the first transistor T1 and the first node N1. In other words, the fifth transistor T5 may be connected between the gate electrode of the first transistor T1 and the second electrode of the first transistor T1.

A gate electrode of the fifth transistor T5 may be connected to the i-th scan line Si. The fifth transistor T5 may be turned on to connect the first transistor T1 in a diode form when the scan signal is supplied to the i-th scan line Si.

The sixth transistor T6 may be connected between the first node N1 and the initialization power source VINT. In other words, the sixth transistor T6 may be connected between the gate electrode of the first transistor T1 and the initialization power source VINT.

A gate electrode of the sixth transistor T6 may be connected to the (i−1)-th scan line Si−1. The sixth transistor T6 may be turned on to supply a voltage of the initialization power source VINT to the first node N1 when the scan signal is supplied to the (i−1)-th scan line Si−1.

In some embodiments, as illustrated in FIG. 2B, the gate electrode of the sixth transistor T6 may be connected to an i-th first control line C1*i*. The sixth transistor T6 may be turned on to supply the voltage of the initialization power source VINT to the first node N1 when a first control signal is supplied to the i-th first control line C1*i*.

The seventh transistor T7 may be connected between the anode electrode of the organic light emitting diode OLED and the initialization power source VINT. A gate electrode of the seventh transistor T7 may be connected to the (i+1)-th scan line Si+1.

The fifth transistor T5 may be turned on to supply the voltage of the initialization power source VINT to the anode electrode of the organic light emitting diode OLED when the scan signal is supplied to the (i+1)-th scan line Si+1.

In some embodiments, as illustrated in FIG. 2B, the gate electrode of the seventh transistor T7 may be connected to an i-th second control line C2*i*. The seventh transistor T7 may be turned on to supply the voltage of the initialization power source VINT to the anode electrode of the organic light emitting diode OLED when a second control signal is supplied to the i-th second control line C2*i*.

In some embodiments, the gate electrode of the seventh transistor T7 may be connected to the (i−1)-th scan line Si−1 or the i-th scan line Si.

The voltage of the initialization power source VINT may be set to a voltage lower than the data signal.

The storage capacitor Cst may be connected between the first power source ELVDD and the first node N1. In other words, the storage capacitor Cst may be connected between the first power source ELVDD and the gate electrode of the first transistor T1.

The storage capacitor Cst may store a voltage corresponding to the data signal and a threshold voltage of the first transistor T1.

The organic light emitting diode OLED may generate light of one or more specified colors, e.g., one of red, green, and blue, corresponding to the amount of current supplied from the driving transistor, but is not limited thereto. For example, the organic light emitting diode OLED may generate white light corresponding to the amount of current supplied from the driving transistor. In this example, a color image may be realized/formed/displayed using a separate color filter or the like.

Figure 3A:
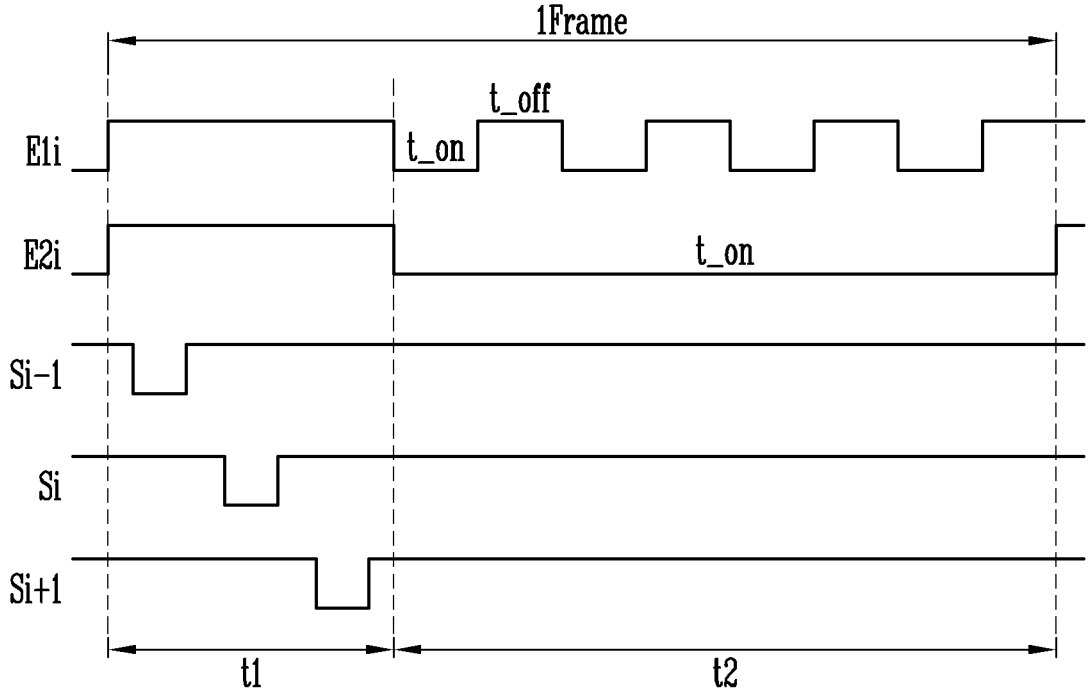
FIG. 3A, FIG. 3B, and FIG. 3C are timing diagrams illustrating methods for driving a pixel according to example embodiments.
Figure 3B:
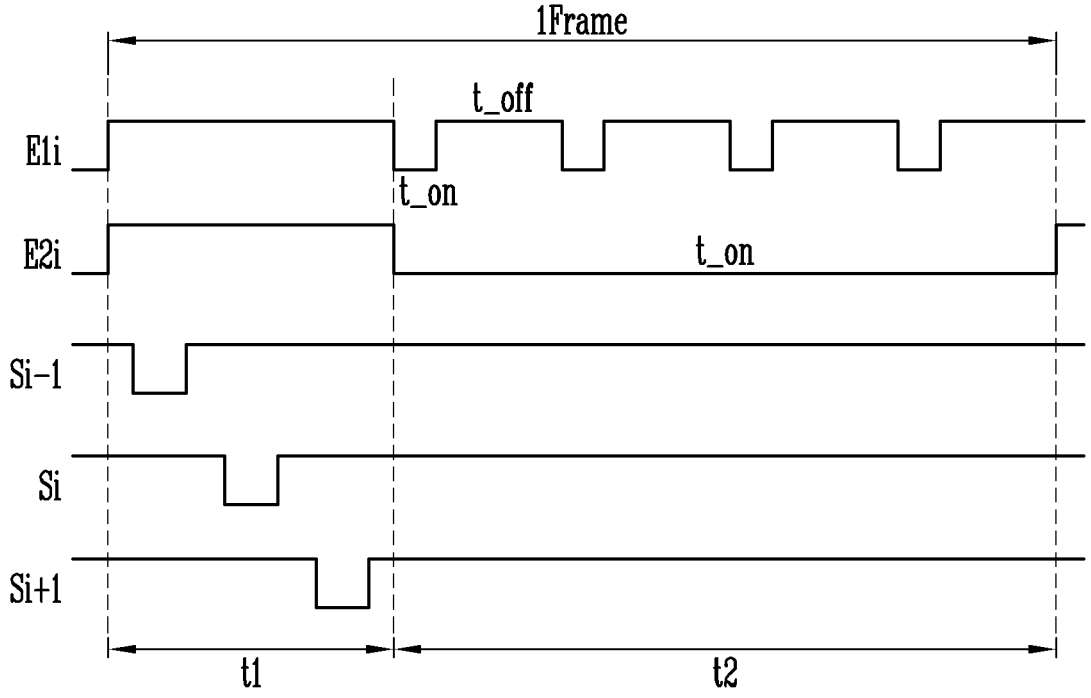
Figure 3C:
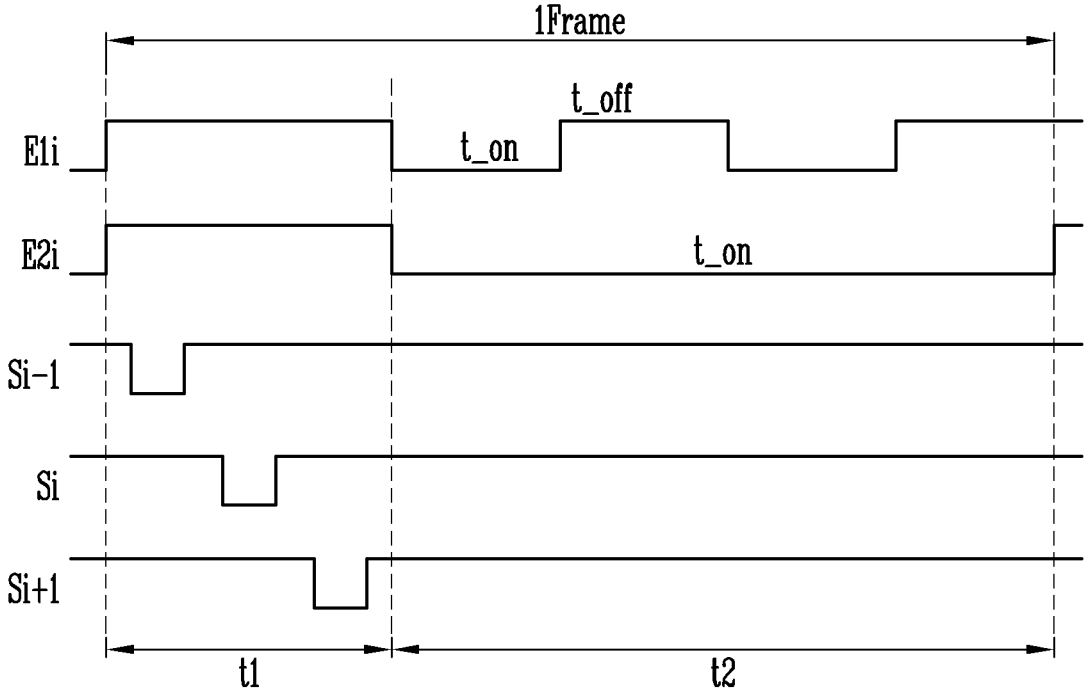

FIGS. 3A to 3C are timing diagrams illustrating methods for driving a pixel according to example embodiments.

In FIGS. 3A to 3C, during one frame period, a first emission control signal is supplied to the i-th first emission control line E1*i*, a second emission control signal is supplied to the i-th second emission control line E2*i*, a scan signal is supplied to the (i−1)-th scan line Si−1, a scan signal is supplied to the i-th scan line Si, and a scan signal is supplied to the (i+1)-th scan line Si+1.

Although the pixel driving method has been described by taking the pixel PX of FIG. 2A as an example, the scan signal supplied to the (i−1)-th scan line Si may be replaced with the first control signal supplied to the first control line C1*i*, and the scan signal supplied to the (i+1)-th scan line Si+1 may be replaced with the second control signal supplied to the second control line C1*i* as illustrated in FIG. 2B.

Referring to FIG. 3A, one frame may be divided into (or may include) a first period t1 and a second period t2.

First, during the first period t1, the first emission control signal having the gate-off voltage may be supplied to the i-th first emission control line E1*i*, and the second emission control signal having the gate-off voltage may be supplied to the i-th second emission control line E2*i*. When the first emission control signal having the gate-off voltage and the second emission control signal having the gate-off voltage are supplied, the second transistor T2 and the third transistor T3 may be turned off.

When the second transistor T2 is turned off, the second electrode of the first transistor T1 and the anode electrode of the organic light emitting diode OLED may be electrically disconnected. When the third transistor T3 is turned off, the first power source ELVDD and the first electrode of the first transistor T1 may be electrically disconnected. Therefore, the pixel PX may be set to a non-emission state during the first period t1.

After the first emission control signal having the gate-off voltage and the second emission control signal having the gate-off voltage are supplied, the scan signal may be supplied to the (i−1)-th scan line Si−1. When the scan signal is supplied to the (i−1)-th scan line Si−1, the sixth transistor T6 may be turned on. When the sixth transistor T6 is turned on, the voltage of the initialization power source VINT may be supplied to the first node N1.

After the scan signal is supplied to the (i−1)-th scan line Si−1, the scan signal may be supplied to the i-th scan line Si. When the scan signal is supplied to the i-th scan line Si, the fourth transistor T4 and the fifth transistor T5 may be turned on.

When the fifth transistor T5 is turned on, the second electrode of the first transistor T1 and the first node N1 may be electrically connected. That is, when the fifth transistor T5 is turned on, the first transistor T1 may be connected in the diode form.

When the fourth transistor T4 is turned on, the data signal from the data line Dm may be supplied to the first electrode of the first transistor T1. Since the first node N1 is set to the voltage of the initialization power source VINT lower than the voltage of the data signal, the first transistor T1 may be turned on.

When the first transistor T1 is turned on, a voltage obtained by subtracting the absolute value of the threshold voltage of the first transistor T1 from the voltage of the data signal may be supplied to the first node N1. The storage capacitor Cst may store the voltage corresponding to the first node N1.

After the threshold voltage of the first transistor T1 and the voltage corresponding to the data signal are stored in the storage capacitor Cst, the scan signal may be supplied to the (i+1)-th scan line Si+1. When the scan signal is supplied to the (i+1)-th scan line Si+1, the seventh transistor T7 may be turned on.

When the seventh transistor T7 is turned on, the voltage of the initialization power source VINT may be supplied to the anode electrode of the organic light emitting diode OLED. Then, an organic capacitor (i.e., parasitic capacitance) of the organic light emitting diode OLED may be discharged.

Next, during the second period t2, a first emission control signal, in which gate-on voltages and gate-off voltages are alternately applied, may be supplied to the i-th first emission control line E1*i*. That is, the first emission control signal may have a plurality of turn-on periods t_on and a plurality of turn-off periods t_off during the second period t2.

Throughout the second period t2, a second emission control signal having the gate-on voltage may be supplied to the i-th second emission control line E2*i*. That is, the second emission control signal may have exactly one turn-on period t_on during the second period t2.

As illustrated in FIG. 3A, during the second period t2, the turn-off periods t_off of the first emission control signal may overlap the turn-on period t_on of the second emission control signal. Accordingly, turned-off periods of the second transistor T2 may overlap a turned-on period of the third transistor T3. A width and the number of turn-on periods t_on of the first emission control signal may be configured according to embodiments. However, the turn-on period t_on of the second emission control signal may equal to the length of the second period and may be constant for every frame.

When a gate-on voltage of the first emission control signal and the gate-on voltage of the second emission control signal are supplied, the second transistor T2 and the third transistor T3 may be turned on. That is, when both the first emission control signal and the second emission control signal are in a turn-on period t_on, the second transistor T2 and the third transistor T3 may be turned on and/or may remain on simultaneously.

When the second transistor T2 is turned on, the second electrode of the first transistor T1 may be electrically connected to the anode electrode of the organic light emitting diode OLED. When the third transistor T3 is turned on, the first power ELVDD and the first electrode of the first transistor T1 may be electrically connected.

The first transistor T1 may control the amount of current flowing from the first power source ELVDD to the second power source ELVSS via the organic light emitting diode OLED in response to the voltage of the first node N1. The organic light emitting diode OLED may generate light of a predetermined luminance corresponding to the amount of current supplied from the first transistor T1.

When a gate-off voltage of the first emission control signal and the gate-on voltage of the second emission control signal are supplied, the second transistor T2 may be turned off and the third transistor T3 may remain on. That is, when the first emission control signal has a turn-off period t_off and the second emission control signal has the turn-on period t_on, the second transistor T2 may be turned off, and the third transistor T3 may remain on.

When the second transistor T2 is turned on, the second electrode of the first transistor T1 may be electrically connected to the anode electrode of the organic light emitting diode OLED. However, when the third transistor T3 is turned off, the first power source ELVDD and the first electrode of the first transistor T1 may be electrically disconnected. Therefore, the pixel PX may be set to the non-emission state.

As a result, during the second period t2, the pixel PX may alternate between the emission state and the non-emission state.

The organic light emitting display device according to example embodiments may be driven by the impulse driving for controlling a pulse width of the first emission control signal. A ratio of the turn-on period t_on and the turn-off period t_off of the first emission control signal applied during the second period t2 may correspond to the data signal and may be determined by the timing controller and/or the first emission driver. Referring to FIG. 3B, the organic light emitting display device may display a low gray level by reducing the ratio of the turn-on period t_on of the first emission control signal.

In some embodiments, as illustrated in FIG. 3C, the number of turn-on periods t_on and the number of turn-off periods t_off of the first emission control signal supplied during the second period t2 each may be set to at least two.

In the turn-off periods t_off of the first emission control signal in the second period t2, the source node N2 of the driving transistor T1 may be floated, and a voltage of the source node N2 may be affected by adjacent lines. If the second emission control signal is not applied, a gate-source voltage of the driving transistor T1 may be affected and crosstalk may occur.

The organic light emitting display may maintain the turn-on period t_on of the second emission control signal during the turn-off periods t_off of the first emission control signal so that the source node N2 may be connected to the first power source ELVDD to prevent voltage fluctuation. Advantageously, crosstalk may be reduced and luminance deviation may be minimized.

Therefore, in impulse driving, example embodiments may connect a source node of a driving transistor to the first power source when an emission control transistor is repeatedly turned on and off, thereby minimizing or preventing voltage fluctuation. Advantageously, crosstalk may be reduced, and luminance deviation may be minimized.

Although example embodiments have been described, many modifications are possible in the example embodiments without materially departing from the novel teachings and advantages of example embodiments. All such modifications are intended to be included within the scope defined in the claims. In the claims, means-plus-function clauses are intended to cover the structures described herein as performing the recited function and not only structural equivalents but also equivalent structures.

What is claimed is:

1. A pixel comprising:

an organic light emitting diode;

a first transistor comprising a first electrode, a second electrode, and a gate electrode and configured for controlling an amount of a current applied to the organic light emitting diode from a first power source, wherein the gate electrode of the first transistor is electrically connected to a first node of the pixel;

a second transistor electrically connected between the organic light emitting diode and the second electrode of the first transistor, wherein the second transistor is configured to turn on in response to a first emission control signal; and a third transistor electrically connected between the first power source and the first electrode of the first transistor, wherein the third transistor is configured to turn on in response to a second emission control signal, wherein the second transistor is configured to turn on two or more times during one frame, and wherein the third transistor is configured to turn on exactly once in the one frame.

2. The pixel of claim 1, wherein during the one frame, periods in which the second transistor is off overlap a period in which the third transistor is on.

3. The pixel of claim 1, wherein the second transistor and the third transistor are off during a first period in the one frame.

4. The pixel of claim 1, further comprising:

a fourth transistor electrically connected between a data line and the first electrode of the first transistor and including a gate electrode electrically connected to an i-th scan line, where i is a positive integer;

a fifth transistor electrically connected between the first node and the second electrode of the first transistor and including a gate electrode electrically connected to the i-th scan line;

a sixth transistor electrically connected between the first node and an initialization power source and including a gate electrode electrically connected to an (i−1)-th scan line;

a seventh transistor electrically connected between the initialization power source and the organic light emitting diode and including a gate electrode electrically connected to an (i+1)-th scan line; and a storage capacitor electrically connected between the first power source and the first node.

5. The pixel of claim 4, wherein a voltage of the initialization power source is set so that the organic light emitting diode does not emit light.

6. An organic light emitting display device comprising:

a pixel;

a scan line, a data line, a first emission control line, and a second emission control line electrically insulated from one another and each electrically connected to the pixel;

a scan driver applying a scan signal to the pixel through the scan line;

a data driver applying a data signal to the pixel through the data line;

a first emission driver applying a first emission control signal to the pixel through the first emission control line; and a second emission driver applying a second emission control signal to the pixel through the second emission control line, wherein the first emission control line and the second emission control line are respectively electrically connected to two gate electrodes of two different transistors in the pixel, wherein the first emission control signal has a plurality of on periods during one frame, and wherein the second emission control signal has exactly one on period during the one frame.

7. The device of claim 6, wherein off periods of the first emission control signal overlap the on period of the second emission control signal during the one frame.

8. The device of claim 6, wherein the first emission control signal and the second emission control signal are off signals during a first period of the one frame.

9. The device of claim 6, further comprising a timing controller electrically connected to the first emission driver, wherein at least one of the timing controller and the first emission driver is configured to adjust a ratio of an on period to an off period of the first emission control signal applied during the one frame in response to the data signal.

10. The device of claim 6, wherein an on period of the second emission control signal is substantially constant for every frame of a plurality of frames.

11. The device of claim 6, wherein the pixel includes:

an organic light emitting diode;

a first transistor comprising a first electrode, a second electrode, and a gate electrode and configured for controlling a current applied to the organic light emitting diode from a first power source, wherein the gate electrode of the first transistor is electrically connected to a first node of the pixel;

a second transistor electrically connected between the organic light emitting diode and the second electrode of the first transistor and including a gate electrode connected to the first emission control line; and a third transistor electrically connected between the first power source and the first electrode of the first transistor and including a gate electrode connected to the second emission control line.

12. The device of claim 11, wherein the pixel further includes:

a fourth transistor electrically connected between the data line and the first electrode of the first transistor and including a gate electrode electrically connected to the scan line;

a fifth transistor electrically connected between the first node and the second electrode of the first transistor and including a gate electrode electrically connected to the scan line;

a first control line configured to transmit a first control signal;

a sixth transistor electrically connected between the first node and an initialization power source and including a gate electrode electrically connected to the first control line;

a second control line configured to transmit a second control signal;

a seventh transistor electrically connected between the initialization power source and the organic light emitting diode and including a gate electrode electrically connected to the second control line; and a storage capacitor electrically connected between the first power source and the first node.

13. The device of claim 12, wherein a voltage of the initialization power source is set so that the organic light emitting diode does not emit light.

14. A method of operating a pixel that comprises an organic light emitting diode, a first transistor, a second transistor, and a third transistor, the method comprising:

turning on the second transistor two or more times during one frame; and turning on the third transistor exactly once in the one frame, wherein the first transistor comprises a first electrode, a second electrode, and a gate electrode and is configured for controlling an amount of a current applied to the organic light emitting diode from a first power source, wherein the gate electrode of the first transistor is electrically connected to a first node of the pixel, wherein the second transistor is electrically connected between the organic light emitting diode and the second electrode of the first transistor and is turned on in response to a first emission control signal, and wherein the third transistor is electrically connected between the first power source and the first electrode of the first transistor and is turned on in response to a second emission control signal.

* * * * *